US011096248B2

(12) United States Patent
Colhour et al.

(10) Patent No.: US 11,096,248 B2
(45) Date of Patent: Aug. 17, 2021

(54) RESISTIVE HEATER WITH TEMPERATURE SENSING POWER PINS AND AUXILIARY SENSING JUNCTION

(71) Applicant: Watlow Electric Manufacturing Company, St. Louis, MO (US)

(72) Inventors: Terry Colhour, St. Louis, MO (US); Douglas Schaefer, St. Louis, MO (US); Jeremy Ohse, St. Louis, MO (US); Jacob Burnia, St. Louis, MO (US); Eric Ellis, Columbia, MO (US); Louis P. Steinhauser, St. Louis, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 528 days.

(21) Appl. No.: 15/950,358

(22) Filed: Apr. 11, 2018

(65) Prior Publication Data

US 2018/0235028 A1 Aug. 16, 2018

Related U.S. Application Data

(63) Continuation-in-part of application No. 14/725,537, filed on May 29, 2015, now Pat. No. 10,728,956.

(51) Int. Cl.
*H05B 3/44* (2006.01)
*H05B 1/02* (2006.01)

(52) U.S. Cl.
CPC ..... *H05B 1/0291* (2013.01); *H05B 1/0202* (2013.01); *H05B 3/44* (2013.01)

(58) Field of Classification Search
CPC ..... H05B 1/0202; H05B 1/0261; H05B 2203/014; H05B 3/0014; H05B 3/06;
(Continued)

(56) References Cited

U.S. PATENT DOCUMENTS 2,747,074 A * 5/1956 Finch ..... B23K 3/0361 219/237
2,897,335 A * 7/1959 Finch ..... B23K 3/033 219/237

(Continued)

FOREIGN PATENT DOCUMENTS

EP 2987579 2/2016
WO 2011116303 9/2011

OTHER PUBLICATIONS

International Search Report for International Application PCT/US2019/025106, dated Jun. 21, 2019.

*Primary Examiner* — Christopher M Koehler
*Assistant Examiner* — Chris Q Liu
(74) *Attorney, Agent, or Firm* — Burris Law, PLLC

(57) ABSTRACT

The present disclosure is directed toward a heater that includes a resistive heating element, a first power pin, and a second power pin. The first power pin forms a first junction with a first end of the resistive heating element, and the second power pin forms a second junction with the second end of the resistive heating element. The second power pin includes a first lead wire and a second lead wire. The first lead wire forms the second junction with the second end of the resistive heating element and defines a first conductive material. The second lead wire forms a primary sensing junction with the first lead wire at a first reference area, and defines a second conductive material different from the first conductive material to measure a temperature at the first reference area based on a voltage change created by the primary sensing junction.

18 Claims, 19 Drawing Sheets

(58) Field of Classification Search
CPC ... H05B 3/18; H05B 3/48; H05B 3/54; H05B 1/0291; H05B 1/0294; H05B 3/44; H05B 2203/016
USPC ..... 219/488, 685, 505, 494, 541, 542, 552, 219/535
See application file for complete search history.

(56) References Cited

U.S. PATENT DOCUMENTS

| | | | | | |
|---|---|---|---|---|---|
| 3,582,616 | A * | 6/1971 | Wrob | H05B 3/48 | 219/541 |
| 3,646,577 | A * | 2/1972 | Ernst | B23K 3/033 | 219/241 |
| 3,699,306 | A * | 10/1972 | Finch | B23K 3/0338 | 219/241 |
| 5,850,072 | A * | 12/1998 | Eckert | C22B 21/0084 | 219/523 |
| 2009/0032519 | A1* | 2/2009 | Schlipf | H05B 3/48 | 219/209 |
| 2009/0095725 | A1* | 4/2009 | Ohashi | B60N 2/5685 | 219/202 |
| 2015/0353521 | A1* | 12/2015 | Wolfle | C07D 317/38 | 549/229 |
| 2017/0028497 | A1* | 2/2017 | Matsuzaki | G01K 7/02 | |

* cited by examiner

RESISTIVE HEATER WITH TEMPERATURE SENSING POWER PINS AND AUXILIARY SENSING JUNCTION

CROSS-REFERENCE

The present application is a continuation-in-part application of U.S. Ser. No. 14/725,537, filed May 29, 2015, and titled "Resistive Heater with Temperature Sensing Power Pins," the content of which is incorporated herein by reference in its entirety.

FIELD

The present disclosure relates to resistive heaters and to temperature sensing devices such as thermocouples.

BACKGROUND

The statements in this section merely provide background information related to the present disclosure and may not constitute prior art.

Resistive heaters are used in a variety of applications to provide heat to a target and/or environment. One type of resistive heater known in the art is a cartridge heater, which generally consists of a resistive wire heating element wound around a ceramic core. A typical ceramic core defines two longitudinal bores with power/terminal pins disposed therein. A first end of the resistive wire is electrically connected to one power pin and the other end of the resistive wire electrically connected to the other power pin. This assembly is then inserted into a tubular metal sheath of a larger diameter having an open end and a closed end, or two open ends, thus creating an annular space between the sheath and the resistive wire/core assembly. An insulative material, such as magnesium oxide (MgO) or the like, is poured into the open end of the sheath to fill the annular space between the resistive wire and the inner surface of the sheath.

The open end of the sheath is sealed, for example by using a potting compound and/or discrete sealing members. The entire assembly is then compacted or compressed, as by swaging or by other suitable process, to reduce the diameter of the sheath and to thus compact and compress the MgO and to at least partially crush the ceramic core so as to collapse the core about the pins to ensure good electrical contact and thermal transfer. The compacted MgO provides a relatively good heat transfer path between the heating element and the sheath and it also electrically insulates the sheath from the heating element.

In order to determine the proper temperature at which the heaters should be operating, discrete temperature sensors, for example thermocouples, are placed on or near the heater. Adding discrete temperature sensors to the heater and its environment can be costly and add complexity to the overall heating system.

SUMMARY

This section provides a general summary of the disclosure, and is not a comprehensive disclosure of its full scope or all of its features.

In one form, the present disclosure is directed toward a heater that includes a resistive heating element, a first power pin, and a second power ping. The first power pin forms a first junction with a first end of the resistive heating element. The second power pin includes a first lead wire and a second lead wire. The first lead wire forms a second junction with a second end of the resistive heating element and defines a first conductive material. The second lead wire forms a primary sensing junction with the first lead wire at a first reference area. The second lead wire defines a second conductive material different from the first conductive material to measure a temperature at the first reference area based on a voltage change created by the primary sensing junction.

In another form, the first power pin, the first lead wire of the second power pin, and the resistive heating element are made of the same material.

In yet another form, the first and second lead wires are different nickel alloys.

In one form, the first power pin and the first lead wire of the second power pin are made of the same material.

In another form, the heater further includes a controller that is in communication with the first power pin and the second power pin. The controller is configured to switch between a heating mode for directing power to the resistive heating element, and a measuring mode for measuring the voltage change created by the primary sensing junction to determine the temperature at the first reference area.

In yet another form, the heater further includes a controller in communication with the first and second power pins and configured to measure changes in voltage at the first and second junctions without interrupting power to the resistive heating element.

In one form, a Seebeck coefficient of the first power pin, the first lead wire of the second power pin, and the resistive heating element are substantially the same.

In another form, the primary sensing junction is arranged along the resistive heating element between the first end and the second end of the resistive heating element.

In yet another form, the primary sensing junction is arranged outside the heater.

In one form, the first power pin includes a third lead wire and a fourth lead wire. The third lead wire is connected to the first end of the resistive heating element to form the first junction, and defines the first conductive material. The fourth lead wire forms a second primary sensing junction with the third lead wire at a second reference area that is adjacent and in proximity to the first reference area. The fourth lead wire defines a third conductive material different from the first conductive material and the second conductive material to operate as a thermocouple and used in conjunction with the primary sensing junction to determine a temperature between the first and second reference areas.

In one form, Seebeck coefficients of the first lead wire of the second power pin, the third lead wire of the first power pin, and the resistive heating element are substantially the same.

In another form, the heater further includes a heat diffuser arranged about the primary sensing junction.

In yet another form, the heater further includes a non-conductive portion, a sheath, and a sealing member. The non-conductive portion defines a proximal end and a distal end. The non-conductive portion has first and second apertures extending through at least the proximal end. The first and second power pins are disposed within the first and second apertures, and the resistive heating element is disposed around the non-conductive portion. The sheath surrounds the non-conductive portion, and the sealing member is disposed at the proximal end portion of the non-conductive portion and extendis at least partially into the sheath.

In one form, the present disclosure is directed toward a heater that includes a resistive heating element, a first power pin, and a second power pin. The resistive heating element is operable in a heat mode and a sensing mode. In the sensing mode, the resistive heating element senses a temperature at a first reference area along the resistive heating element. The first power pin forms a first junction with a first end of the resistive heating element. The second power pin includes a first lead wire and a second lead wire. The first lead wire forms a second junction with a second end of the resistive heating element and defining a first conductive material. The second lead wire forms a primary sensing junction with the first lead wire at a second reference area. The second lead wire defines a second conductive material different from the first conductive material to measure a temperature at the second reference area based on a voltage change created by the primary sensing junction.

In another form, the heater further includes a controller in communication with the first power pin and the second power pin. The controller is configured to switch between the heating mode for directing power to the resistive heating element, and the sensing mode for measuring resistance of the resistive heating element to determine the temperature at the first reference and for measuring changes in voltage created by the primary sensing junction to determine the temperature at the second reference area. The controller is configured to calculate a temperature at a third reference area based on the temperatures at the first reference area, the second reference area, a heater geometry, and power delivered to the heater element.

In one form, the controller is configured to calibrate the heating element using a temperature measured by the primary sensing junction.

In yet another form, the primary sensing junction is formed along a plane that is different than that that of heating element.

In one form, the first power pin, the first lead wire of the second power pin, and the resistive heating element define one or more conductive materials having substantially the same Seebeck coefficient.

In one form, the present disclosure is directed toward a heater that includes a resistive heating element, a first power pin, and a second power pin. The first power pin forms a first junction with a first end of the resistive heating element. The second power pin includes a first lead wire and a second lead wire. The first lead wire forms a second junction with a second end of the resistive heating element. The second lead wire forms a primary sensing junction with the first lead wire at a reference area. The restive heating element, the first power pin, and the first lead wire are made of a first conductive material. The second lead wire is made of a second conductive material having a different Seebeck coefficient than that of the first conductive material to measure a temperature at the reference area based on a voltage change created by the primary sensing junction.

In another form, the primary sensing junction is arranged along the resistive heating element between the first end and the second end of the resistive heating element.

In yet another form, the primary sensing junction is arranged outside the heater.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
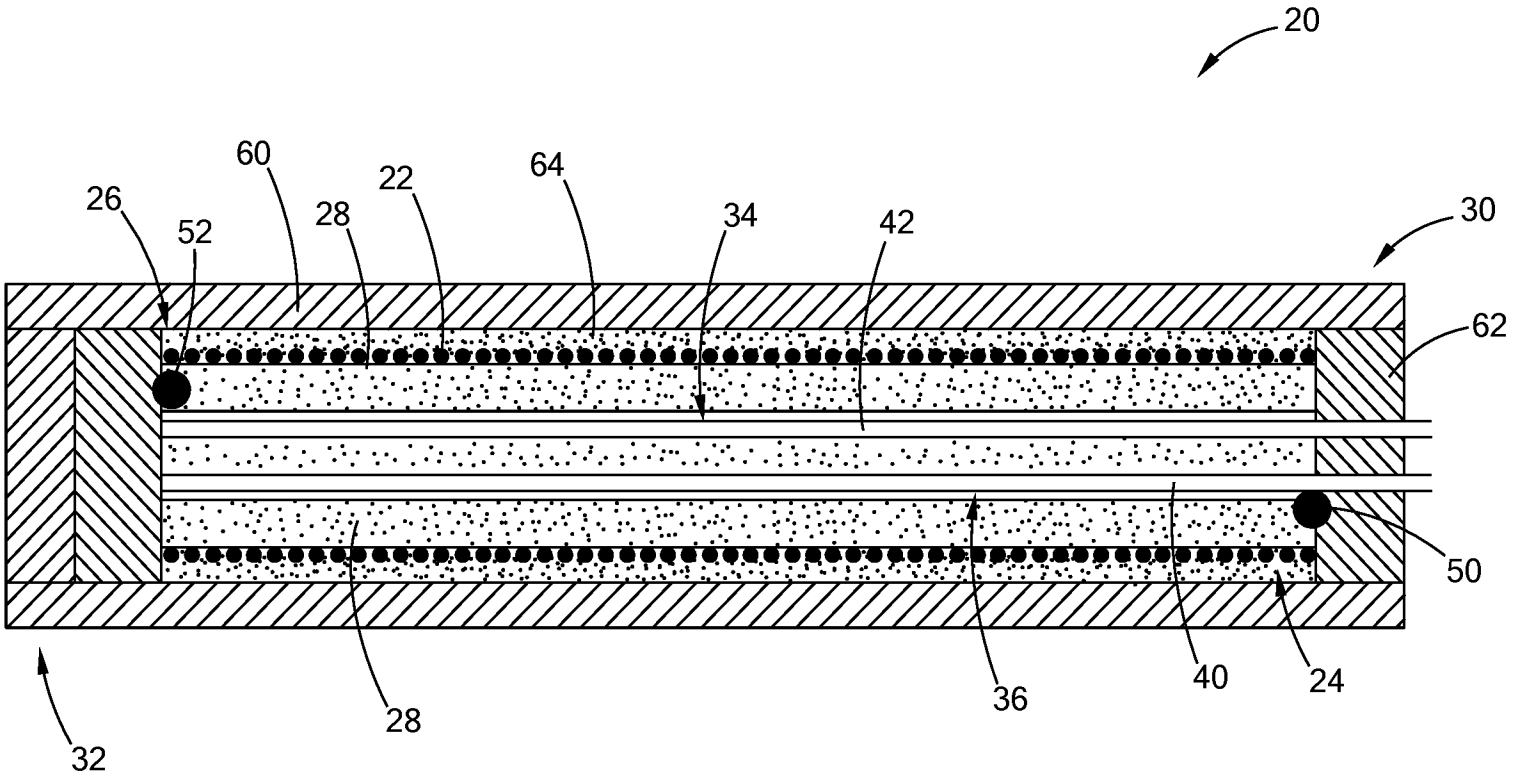
FIG. 1 is a side cross-sectional view of a resistive heater with dual purpose power pins constructed in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, a heater according to teachings of the present disclosure is illustrated and generally indicated by reference numeral 20. The heater 20 in this form is a cartridge heater, however, it should be understood that the teachings of the present disclosure may be applied to other types of heaters as set forth in greater detail below while remaining within the scope of the present disclosure. As shown, the heater 20 comprises a resistive heating element 22 having two end portions 24 and 26, and the resistive heating element 22 is in the form of a metal wire, such as a nichrome material by way of example. The resistive heating element 22 is wound or disposed around a non-conductive portion (or core in this form) 28. The core 28 defines a proximal end 30 and a distal end 32 and further defines first and second apertures 34 and 36 extending through at least the proximal end 30.

The heater 20 further comprises a first power pin 40 that is made of a first conductive material and a second power pin 42 that is made of a second conductive material that is dissimilar from the first conductive material of the first power pin 40. Further, the resistive heating element 22 is made of a material that is different from the first and second conductive materials of the first and second power pins 40, 42 and forms a first junction 50 at end 24 with the first power pin 40 and a second junction 52 at its other end 26 with the second power pin 42. Because the resistive heating element 22 is a different material than the first power pin 40 at junction 50 and is a different material than the second power pin 42 at junction 52, a thermocouple junction is effectively formed and thus changes in voltage at the first and second junctions 50, 52 are detected (as set forth in greater detail below) to determine an average temperature of the heater 20 without the use of a separate/discrete temperature sensor.

In one form, the resistive heating element 22 is a nichrome material, the first power pin 40 is a Chromel® nickel alloy, and the second power pin 42 is an Alumel® nickel alloy. Alternately, the first power pin 40 could be iron, and the second power 42 could be constantan. It should be appreciated by those skilled in the art that any number of different materials and their combinations can be used for the resistive heating element 22, the first power pin 40, and the second power pin 42, as long as the three materials are different and a thermocouple junction is effectively formed at junctions 50 and 52. The materials described herein are merely exemplary and thus should not be construed as limiting the scope of the present disclosure.

In one application, the average temperature of the heater 20 may be used to detect the presence of moisture. If moisture is detected, moisture management control algorithms can then be implemented via a controller (described in greater detail below) in order to remove the moisture in a controlled manner rather than continuing to operate the heater 20 and a possible premature failure.

As further shown, the heater 20 includes a sheath 60 surrounding the non-conductive portion 28 and a sealing member 62 disposed at the proximal end 30 of the non-conductive portion 28 and extending at least partially into the sheath 60 to complete the heater assembly. Additionally, a dielectric fill material 64 is disposed between the resistive heating element 22 and the sheath 60. Various constructions and further structural and electrical details of cartridge heaters are set forth in greater detail in U.S. Pat. Nos. 2,831,951 and 3,970,822, which are commonly assigned with the present application and the contents of which are incorporated herein by reference in their entirety. Therefore, it should be understood that the form illustrated herein is merely exemplary and should not be construed as limiting the scope of the present disclosure.

Figure 2:
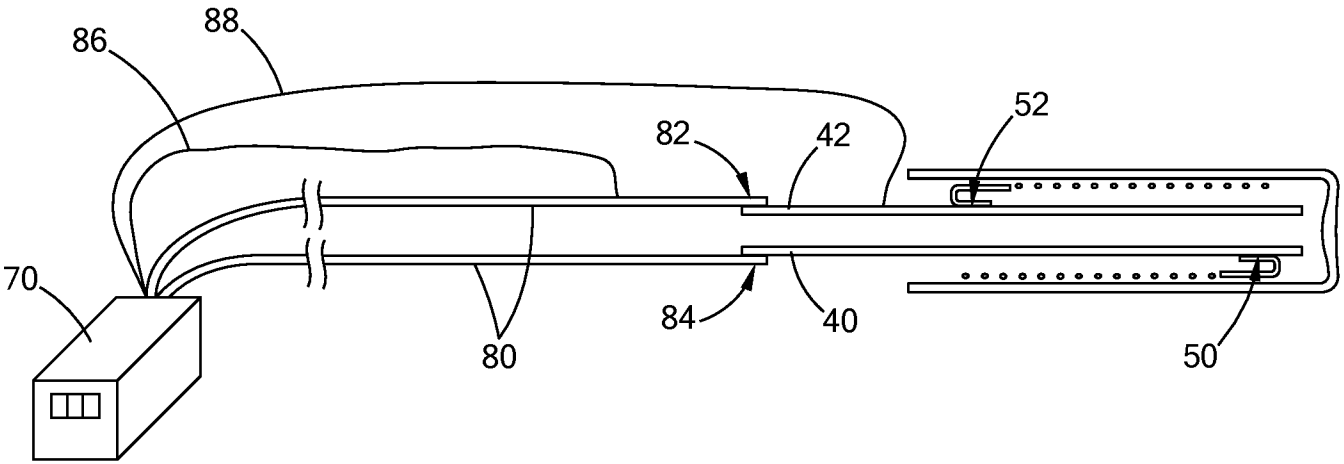
FIG. 2 is a perspective view of the resistive heater of FIG. 1 and a controller with lead wires constructed in accordance with the teachings of the present disclosure.

Referring now to FIG. 2, the present disclosure further includes a controller 70 in communication with the power pins 40, 42 and configured to measure changes in voltage at the first and second junctions 50, 52. More specifically, the controller 70 measures millivolt (mV) changes at the junctions 50, 52 and then uses these changes in voltage to calculate an average temperature of the heater 20. In one form, the controller 70 measures changes in voltage at the junctions 50, 52 without interrupting power to the resistive heating element 22. This may be accomplished, for example, by taking a reading at the zero crossing of an AC input power signal. In another form, power is interrupted and the controller 70 switches from a heating mode to a measuring mode to measure the changes in voltage. Once the average temperature is determined, the controller 70 switches back to the heating mode, which is described in greater detail below. More specifically, in one form, a triac is used to switch AC power to the heater 20, and temperature information is gathered at or near the zero-cross of the power signal. Other forms of AC switching devices may be employed while remaining within the scope of the present disclosure, and thus the use of a triac is merely exemplary and should not be construed as limiting the scope of the present disclosure.

Figure 3:
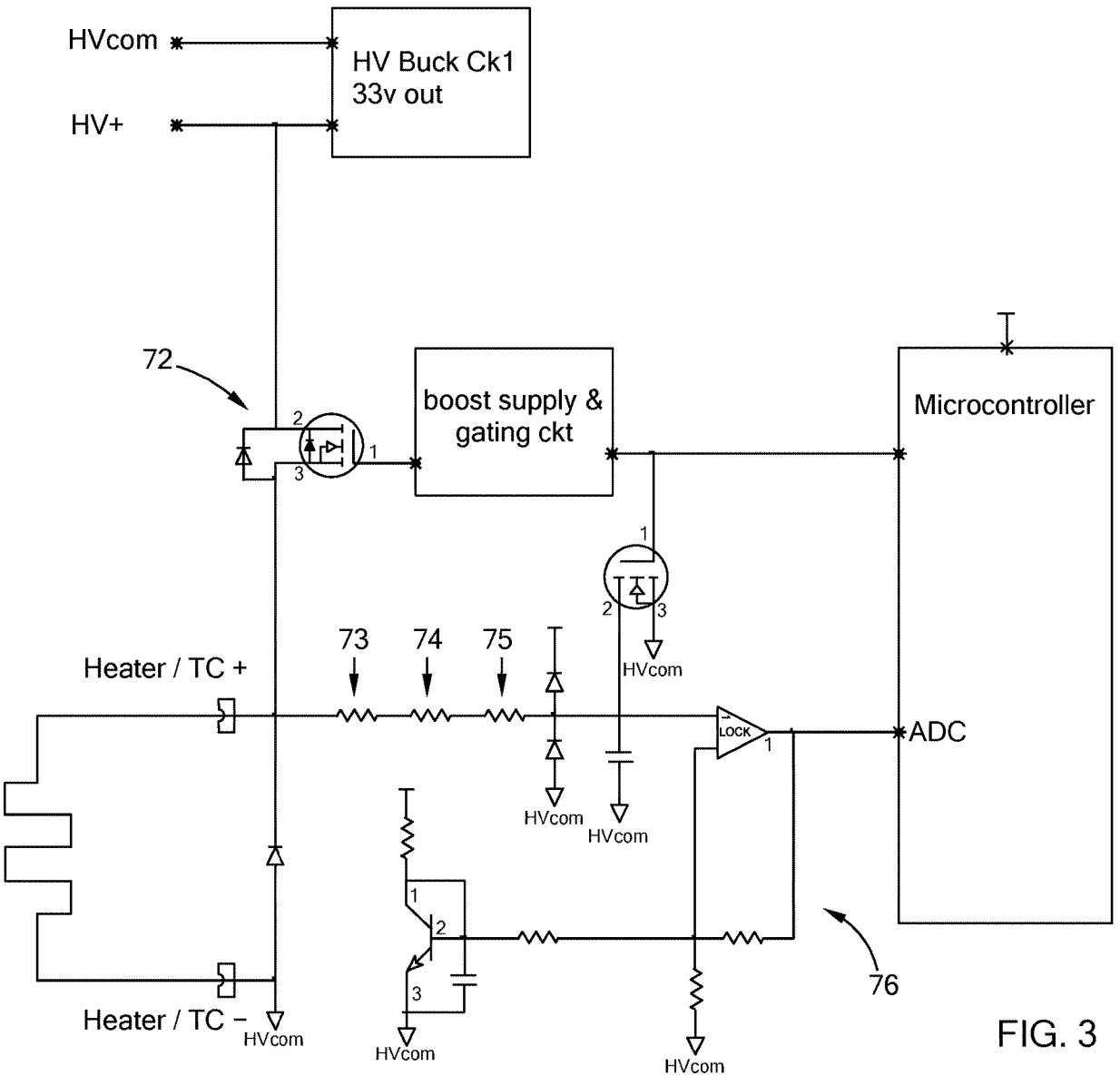
FIG. 3 is a circuit diagram illustrating a switching circuit and measurement circuit constructed in accordance with one form of the present disclosure.

Alternately, as shown in FIG. 3, a FET 72 is used as a switching device and means of measuring voltage during an off-period of the FET with a DC power supply. In one form, three (3) relatively large resistors 73, 74, and 75 are used to form a protective circuit for the measurement circuit 76. It should be understood that this switching and measurement circuit is merely exemplary and should not be construed as limiting the scope of the present disclosure.

Referring back to FIG. 2, a pair of lead wires 80 are connected to the first power pin 40 and the second power pin 42. In one form, the lead wires 80 are both the same material such as, by way of example, copper. The lead wires 80 are provided to reduce the length of power pins needed to reach the controller 70, while introducing another junction by virtue of the different materials at junctions 82 and 84. In this form, in order for the controller 70 to determine which junction is being measured for changes in voltage, signal wires 86 and 88 may be employed such that the controller 70 switches between the signal wires 86 and 88 to identify the junction being measured. Alternately, the signal wires 86 and 88 may be eliminated and the change in voltage across the lead wire junctions 82 and 84 can be negligible or compensated through software in the controller 70.

Figure 4:
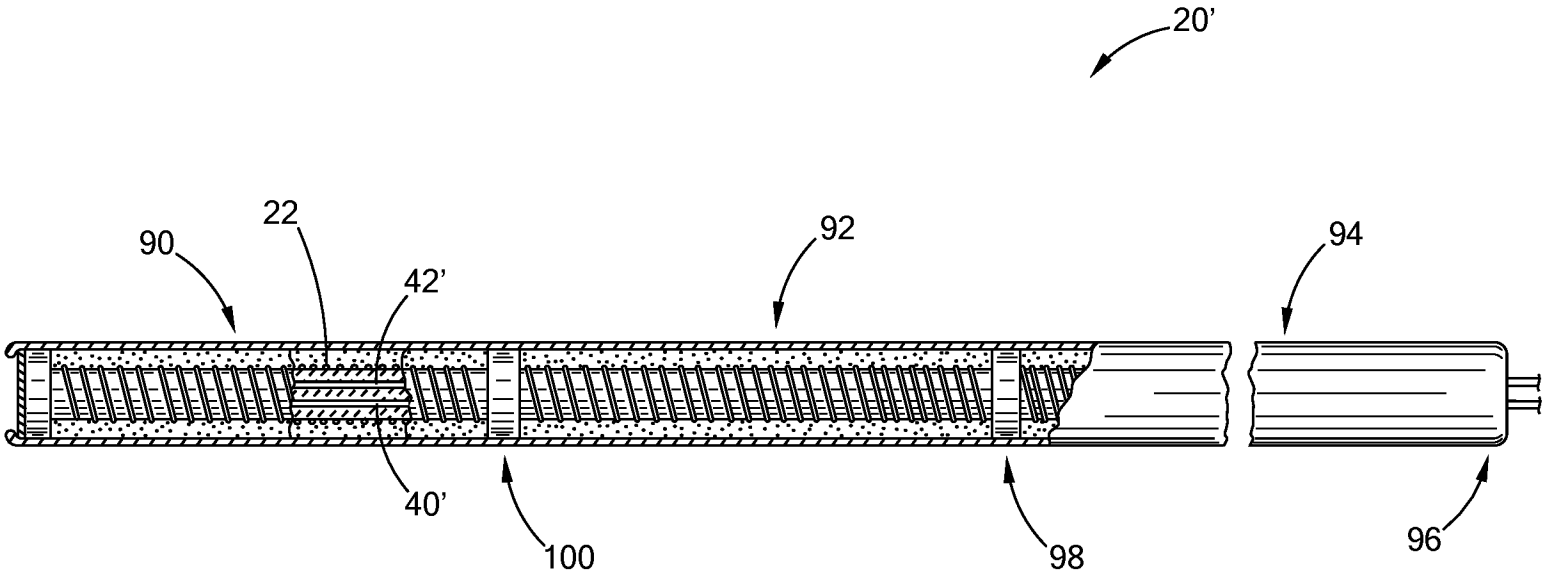
FIG. 4 is a side cross-sectional view of an alternate form of the heater having a plurality of heating zones and constructed in accordance with the teachings of the present disclosure.

Referring now to FIG. 4, the teachings of the present disclosure may also be applied to a heater 20' having a plurality of zones 90, 92 and 94. Each of the zones includes its own set of power pins 40', 42' and resistive heating element 22' as described above (only one zone 90 is illustrated for purposes of clarity). In one form of this multi-zone heater 20', the controller 70 (not shown) would be in communication with the end portions 96, 98, and 100 of each of the zones in order to detect voltage changes and thus determine an average temperature for that specific zone. Alternately, the controller 70 could be in communication with only the end portion 96 to determine the average temperature of the heater 20' and whether or not moisture may be present as set forth above. Although three (3) zones are shown, it should be understood that any number of zones may be employed while remaining within the scope of the present disclosure.

Figure 5:
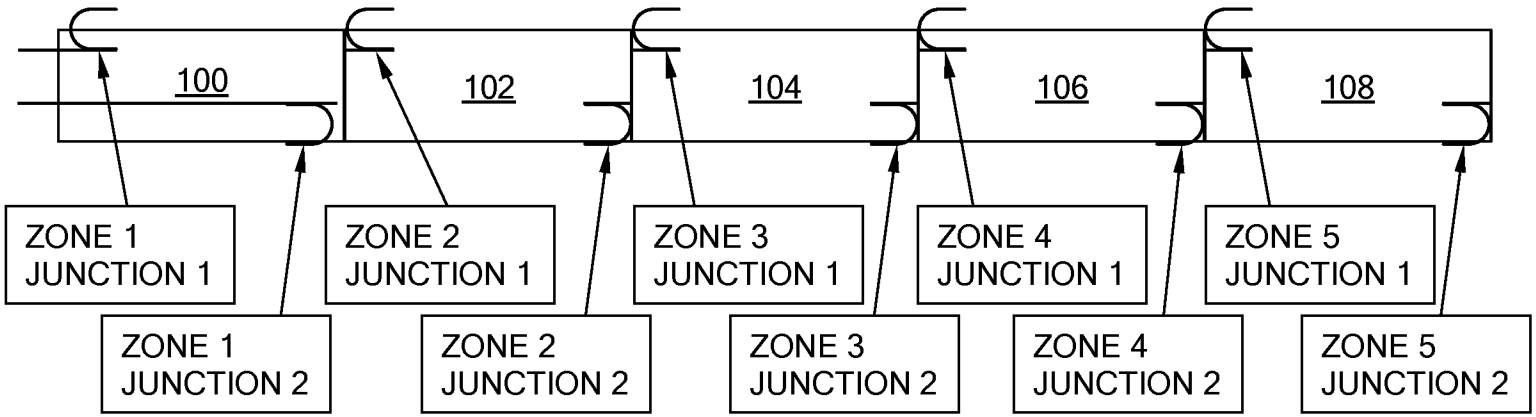
FIG. 5 is a side elevational view of an alternate form of the present disclosure illustrating a plurality of heaters connected in sequence and constructed in accordance with the teachings of the present disclosure.

Turning now to FIG. 5, the teachings of the present disclosure may also be applied to a plurality of separate heaters 100, 102, 104, 106, and 108, which may be cartridge heaters, and which are connected in sequence as shown. Each heater comprises first and second junctions of the dissimilar power pins to the resistive heating element as shown and thus the average temperature of each heater 100, 102, 104, 106, and 108 can be determined by a controller 70 as set forth above. In another form, each of the heaters 100, 102, 104, 106, and 108 has its own power supply pin and a single power return pin is connected to all of the heaters in order to reduce the complexity of this multiple heater embodiment. In this form with cartridge heaters, each core would include passageways to accommodate power supply pins for each successive heater.

Figure 6:
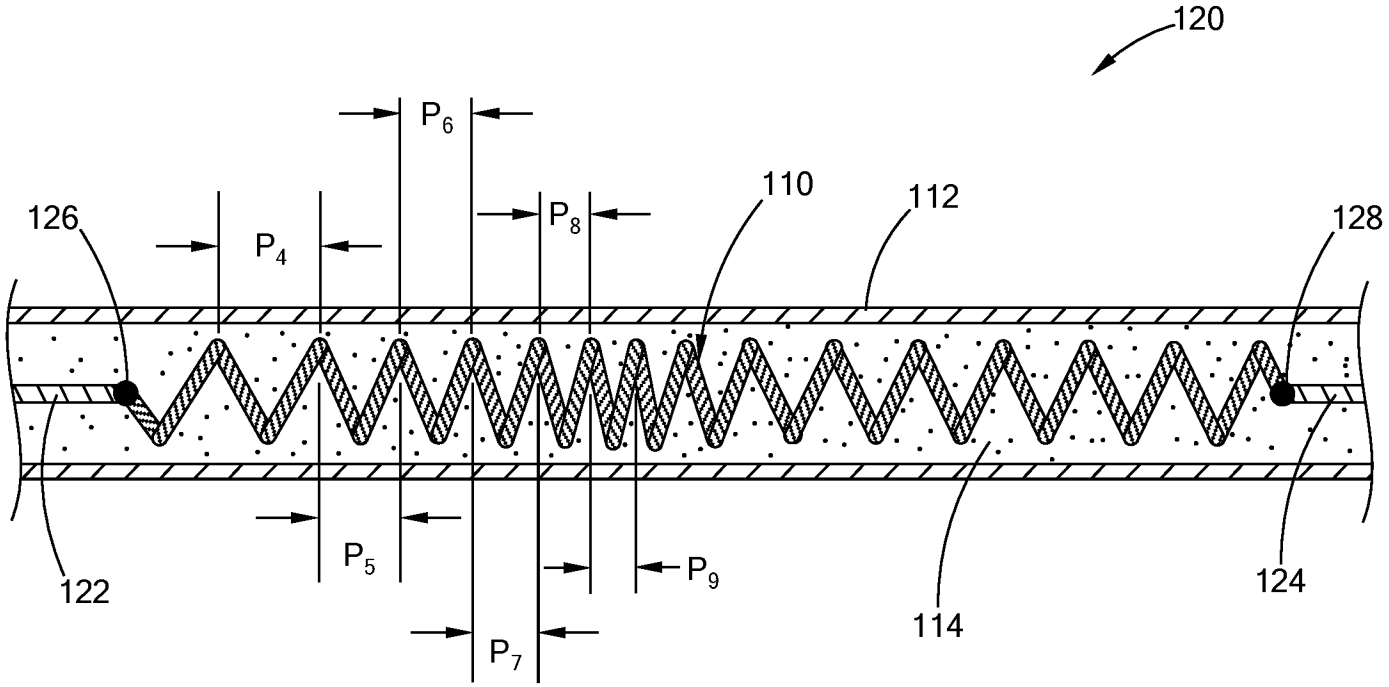
FIG. 6 is a side cross-sectional view of another form of the heater having a resistive element with a continuously variable pitch and constructed in accordance with the teachings of the present disclosure.
Figure 7:
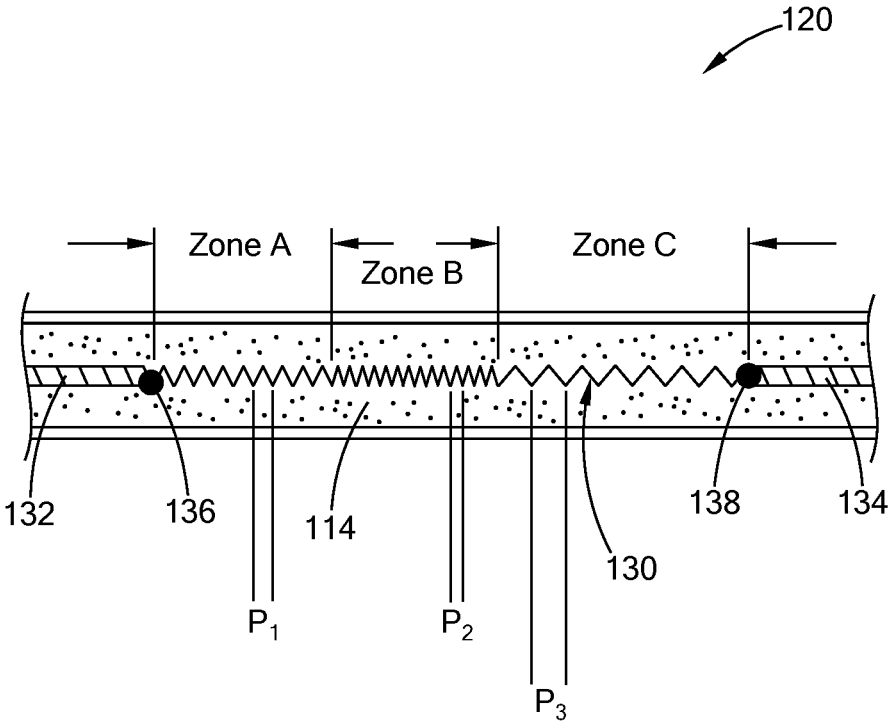
FIG. 7 is a side cross-sectional view of another form of the heater having a resistive element with different pitches in a plurality of heating zones and constructed in accordance with the teachings of the present disclosure.

Referring now to FIGS. 6 and 7, a pitch of the resistive heating element 110 may be varied in accordance with another form of the present disclosure in order to provide a tailored heat profile along the heater 120. In one form (FIG. 5), the resistive heating element 110 defines a continuously variable pitch along its length. More specifically, the resistive heating element 110 has a continuously variable pitch with the ability to accommodate an increasing or decreasing pitch $P_4$-$P_9$ on the immediately adjacent next 360 degree coil loop. The continuously variable pitch of resistive heating element 110 provides gradual changes in the flux density of a heater surface (e.g., the surface of a sheath 112). Although the principle of this continuously variable pitch is shown as applied to a tubular heater having filled insulation 114, the principles may also be applied to any type of heater, including without limitation, the cartridge heater as set forth above. Additionally, as set forth above, the first power pin 122 is made of a first conductive material, the second power pin 124 is made of a second conductive material that is dissimilar from the first conductive material of the first power pin 122, while the resistive heating element 110 is made of a material that is different from the first and second conductive materials of the first and second power pins 122, 124 so that changes in voltage at the first and second junctions 126, 128 are detected to determine an average temperature of the heater 120.

In another form (FIG. 7), the resistive heating element 130 has pitches $P_1$, $P_2$, and $P_3$ in zones A, B, and C, respectively. P3 is greater than P1, and P1 is greater than P2. The resistive heating element 130 has a constant pitch along the length of each zone as shown. Similarly, the first power pin 132 is made of a first conductive material, the second power pin 134 is made of a second conductive material that is dissimilar from the first conductive material of the first power pin 132, while the resistive heating element 130 is made of a material that is different from the first and second conductive materials of the first and second power pins 132, 134 so that changes in voltage at the first and second junctions 136, 138 are detected to determine an average temperature of the heater 120.

Figure 8:
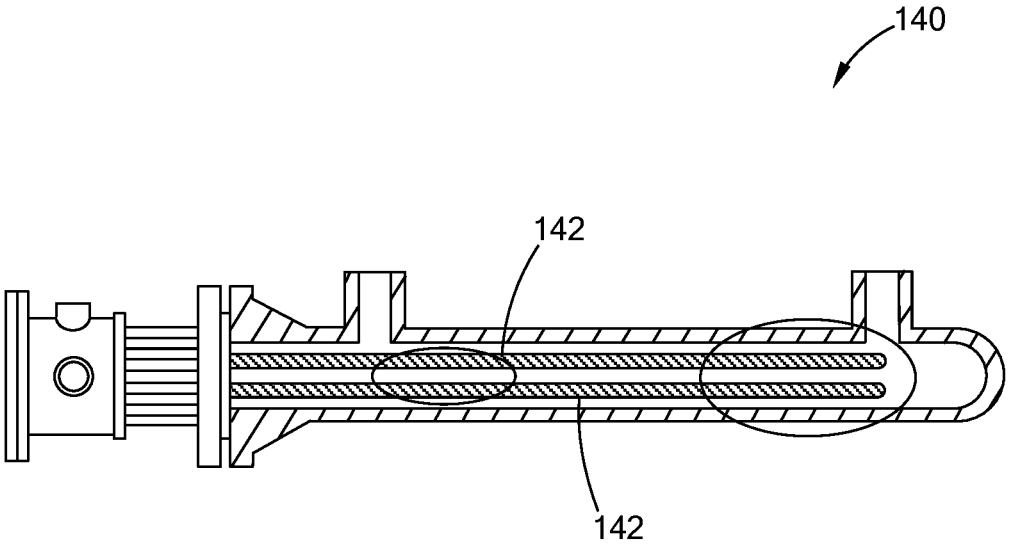
FIG. 8 is a side cross-sectional view of a heat exchanger employing a heater and constructed in accordance with the teachings of the present disclosure.

Referring to FIG. 8, the heater and dual purpose power pins as described herein have numerous applications, including by way of example a heat exchanger 140. The heat exchanger 140 may include one or a plurality of heating elements 142, and each of the heating elements 142 may further include zones or variable pitch resistive heating elements as illustrated and described above while remaining within the scope of the present disclosure. It should be understood that the application of a heat exchanger is merely exemplary and that the teachings of the present disclosure may be employed in any application in which heat is being provided while also requiring a temperature measurement, whether that temperature be absolute or for another environmental condition such as the presence of moisture as set forth above.

Figure 9:
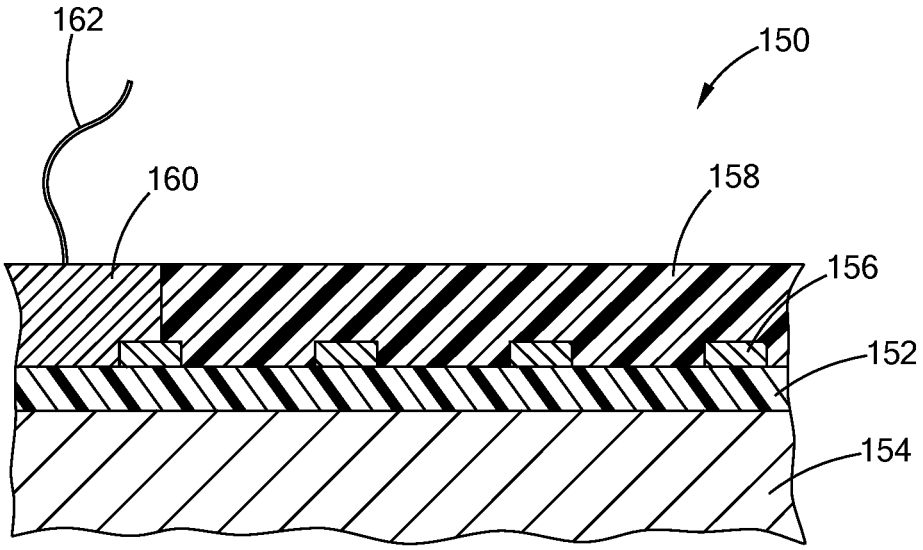
FIG. 9 is a side cross-sectional view illustrating a layered heater employing the dual purpose power pins and constructed in accordance with the teachings of the present disclosure.

As shown in FIG. 9, the teachings of the present disclosure may also be applied to other types of heaters such as a layered heater 150. Generally, the layered heater 150 includes a dielectric layer 152 that is applied to a substrate 154, a resistive heating layer 156 applied to the dielectric layer 152, and a protective layer 158 applied over the resistive heating layer 156. A junction 160 is formed between one end of a trace the resistive layer 158 and a first lead wire 162 (only one end is shown for purposes of clarity), and similarly a second junction is formed at another end, and following the principles of the present disclosure as set forth above, voltage changes at these junctions are detected in order to determine the average temperature of the heater 150. Such layered heaters are illustrated and described in greater detail in U.S. Pat. No. 8,680,443, which is commonly assigned with the present application and the contents of which are incorporated herein by reference in their entirety.

Other types of heaters rather than, or in addition to the cartridge, tubular, and layered heaters as set forth above may also be employed according to the teachings of the present disclosure. These additional types of heaters may include, by way of example, a polymer heater, a flexible heater, heat trace, and a ceramic heater. It should be understood that these types of heaters are merely exemplary and should not be construed as limiting the scope of the present disclosure.

Figure 10:
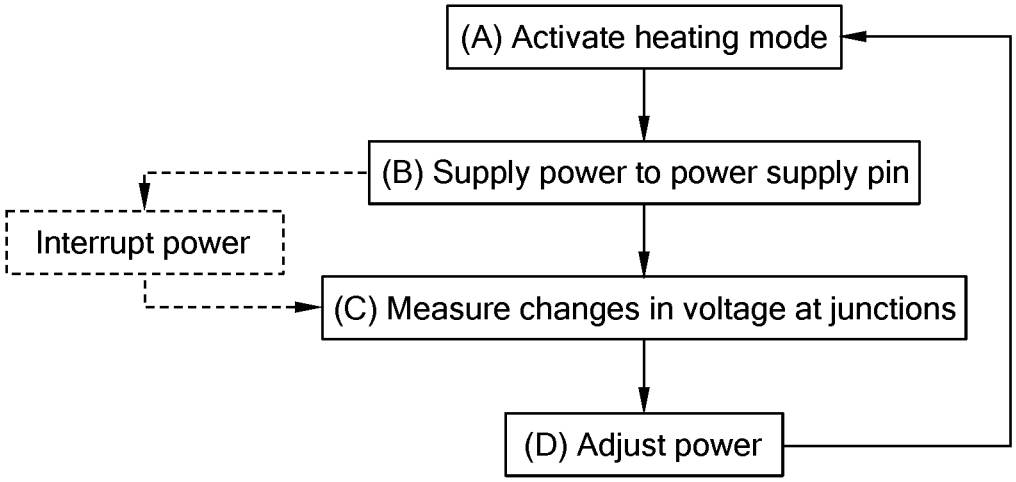
FIG. 10 is a flow diagram illustrating a method in accordance with the teachings of the present disclosure.

Referring now to FIG. 10, a method of controlling at least one heater in accordance with the teachings of the present disclosure is shown. The method comprises the steps of:

(A) activating a heating mode to supply power to a power supply pin, the power supply pin made of a first conductive material, and to return the power through a power return pin, the power return pin made of a conductive material that is dissimilar from the first conductive material;

(B) supplying power to the power supply pin, to a resistive heating element having two ends and made of a material that is different from the first and second conductive materials of the power supply and return pins, the resistive heating element forming a first junction at one end with the power supply pin and a second junction at its other end with the power return pin, and further supplying the power through the power return pin;

(C) measuring changes in voltage at the first and second junctions to determine an average temperature of the heater;

(D) adjusting the power supplied to the heater as needed based on the average temperature determined in step (C); and (E) repeating steps (A) through (D).

In another form of this method, as shown by the dashed lines, step (B) is interrupted while the controller switches to a measuring mode to measure the change in voltage, and then the controller is switched back to the heating mode.

Figure 11:
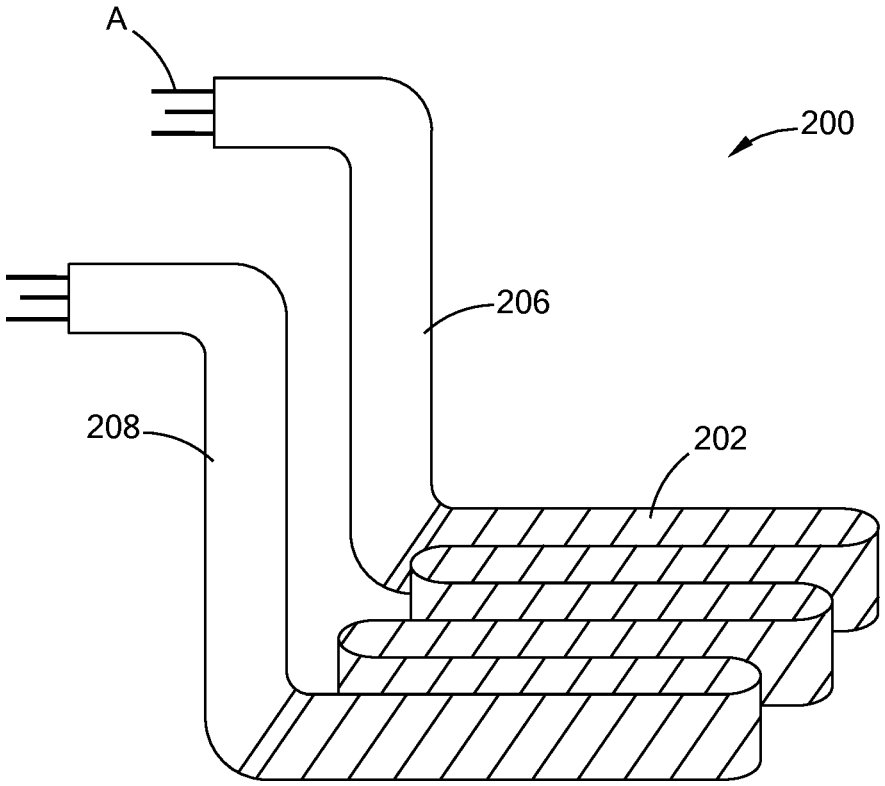
FIG. 11 is a perspective view of a heater for use in fluid immersion heating and constructed in accordance with the teachings of the present disclosure.
Figure 12:
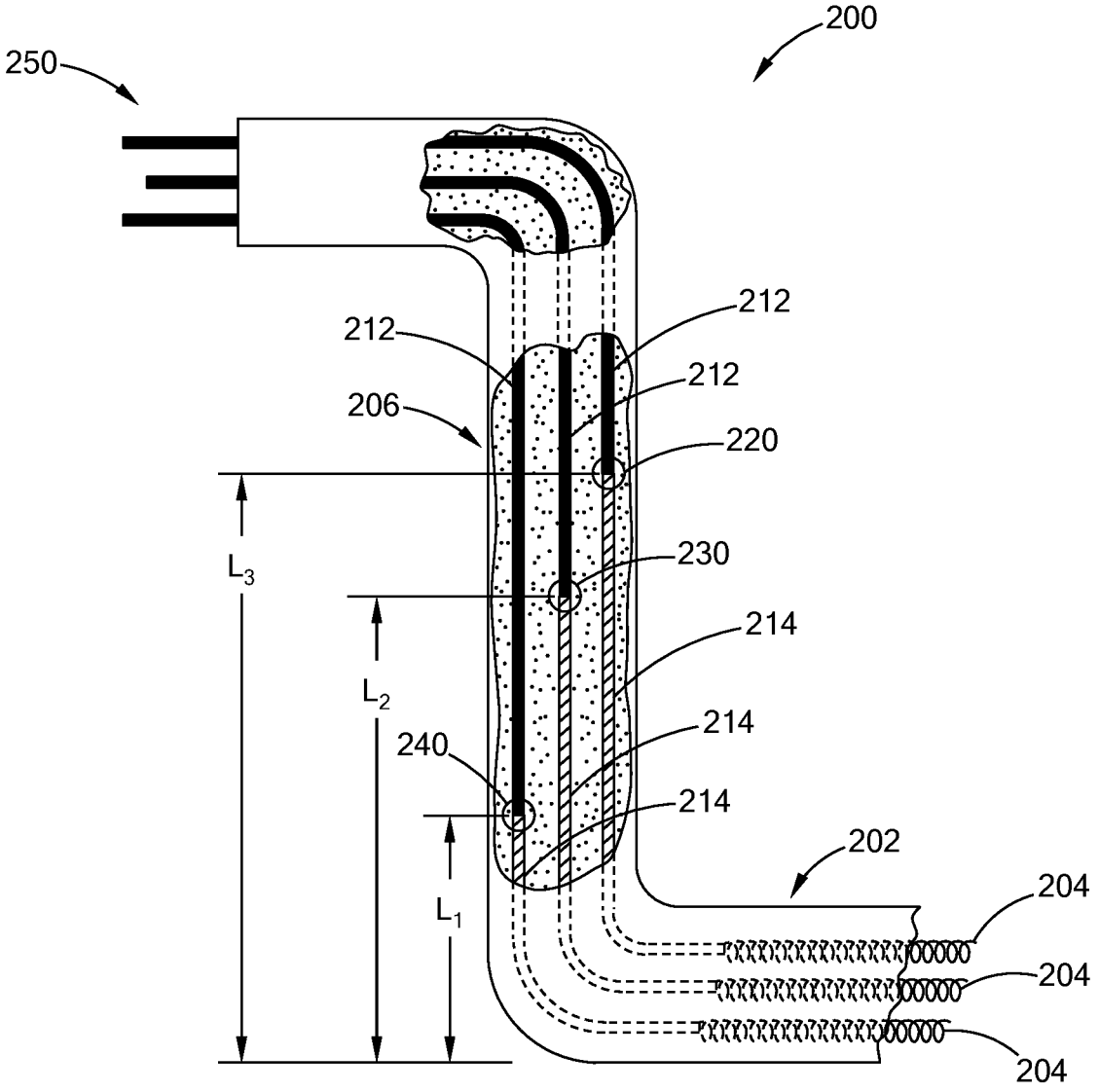
FIG. 12 is a side cross-sectional view of a portion of the heater of FIG. 11 in accordance with the teachings of the present disclosure.
Figure 13:
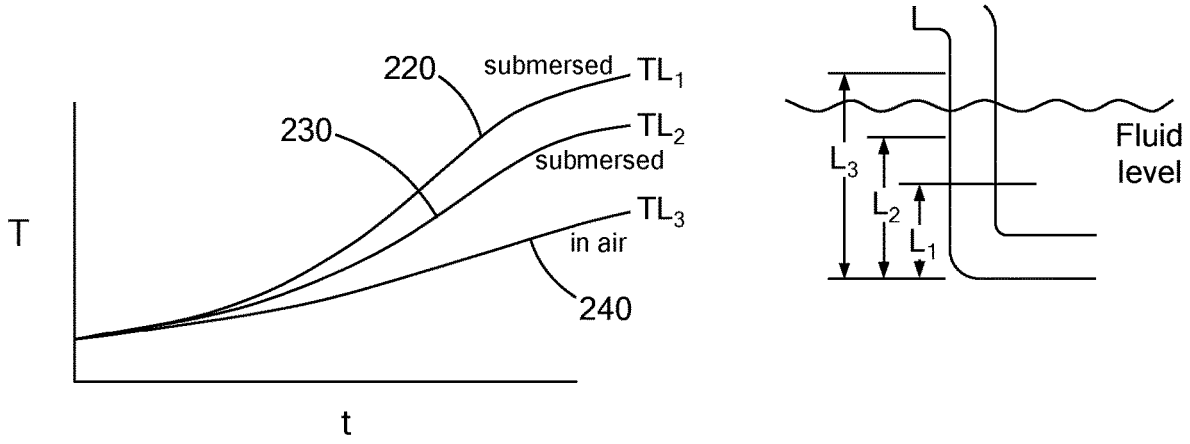
FIG. 13 is a graph illustrating exemplary differences in temperature at the various junctions of the heater of FIG. 10 in accordance with the teachings of the present disclosure.

Yet another form of the present disclosure is shown in FIGS. 11-13, wherein a heater for use in fluid immersion heating is illustrated and generally indicated by reference numeral 200. The heater 200 comprises a heating portion 202 configured for immersion into a fluid, the heating portion 202 comprising a plurality of resistive heating elements 204, and at least two non-heating portions 206, 208 contiguous with the heating portion 202 (only one non-heating portion 206 is shown in FIG. 11). Each non-heating portion 206, 208 defines a length and comprises a corresponding plurality of sets of power pins electrically connected to the plurality of heating elements 204. More specifically, each set of power pins comprises a first power pin 212 made of a first conductive material and a second power pin 214 made of a second conductive material that is dissimilar from the first conductive material of the first power pin 212. The first power pins 212 are electrically connected to the second power pins 214 within the non-heating portions 206, 208 to form junctions 220, 230, and 240. As further shown, the second power pins 214 extend into the heating portion 202 and are electrically connected to the corresponding resistive heating elements 204. Further, the second power pins 214 define a cross-sectional area that is larger than the corresponding resistive heating element 204 so as to not create another junction or measureable amount of heat at the connection between the second power pins 24 and the resistive heating elements 204.

Yet another form of the present disclosure is shown in FIGS. 11-13, wherein a heater for use in fluid immersion heating is illustrated and generally indicated by reference numeral 200. The heater 200 comprises a heating portion 202 configured for immersion into a fluid, the heating portion 202 comprising a plurality of resistive heating elements 204, and at least two non-heating portions 206, 208 contiguous with the heating portion 202 (only one non-heating portion 206 is shown in FIG. 11). Each non-heating portion 206, 208 defines a length and comprises a corresponding plurality of sets of power pins electrically connected to the plurality of heating elements 204. More specifically, each set of power pins comprises a first power pin 212 made of a first conductive material and a second power pin 214 made of a second conductive material that is dissimilar from the first conductive material of the first power pin 212. The first power pins 212 are electrically connected to the second power pins 214 within the non-heating portions 206, 208 to form junctions 220, 230, and 240. As further shown, the second power pins 214 extend into the heating portion 202 and are electrically connected to the corresponding resistive heating elements 204. Further, the second power pins 214 define a cross-sectional area that is larger than the corresponding resistive heating element 204 so as to not create another junction or measureable amount of heat at the connection between the second power pins 214 and the resistive heating elements 204.

As shown in FIG. 13, with temperature of the junctions 220, 230, and 240 over time "t," the junction 220 is submerged in the fluid F, the junction 230 is submerged but not as deep in the fluid, and the junction 240 is not submerged. Accordingly, detecting changes in voltage at each of the junctions 220, 230, and 240 can provide an indication of the fluid level relative to the heating portion 202. It is desirable, especially when the fluid is oil in a cooking/fryer application, that the heating portion 202 not be exposed to air during operation so as to not cause a fire. With the junctions 220, 230, and 240 according to the teachings of the present disclosure, a controller can determine if the fluid level is too close to the heating portion 202 and thus disconnect power from the heater 200.

Although three (3) junctions 220, 230, and 240 are illustrated in this example, it should be understood that any number of junctions may be employed while remaining within the scope of the present disclosure, provided that the junctions are not in the heating portion 202.

Figure 14:
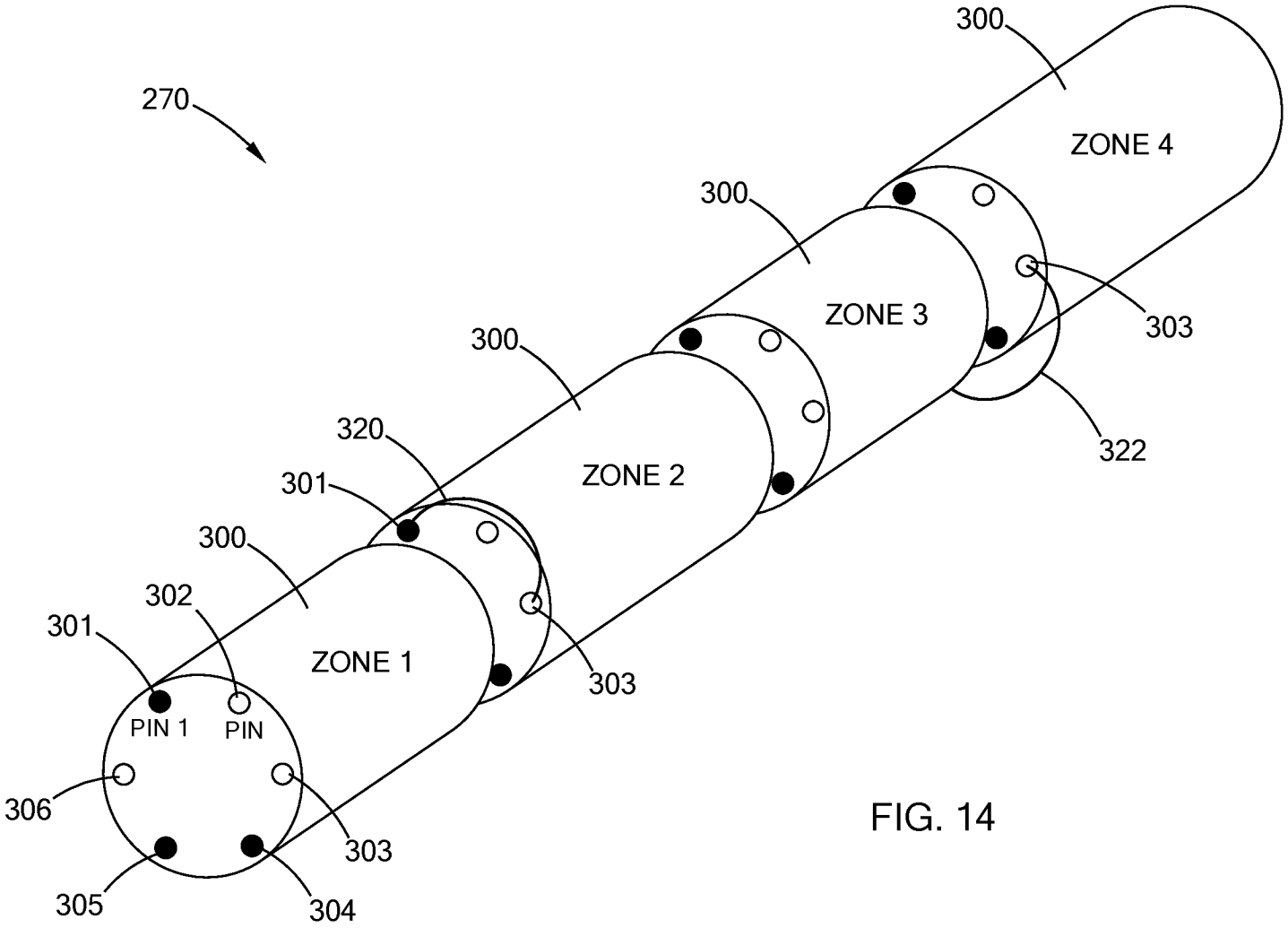
FIG. 14 is a perspective view of another form of the present disclosure having a plurality of heater cores in zones and constructed in accordance with the teachings of the present disclosure.

Referring now to FIG. 14, yet another form of the present disclosure includes a plurality of heater cores 300 arranged in zones of a heater system 270 as shown. The heater cores 300 in this exemplary form are cartridge heaters as described above, however, it should be understood that other types of heaters as set forth herein may also be employed. Accordingly, the cartridge heater construction in this form of the present disclosure should not be construed as limiting the scope of the present disclosure.

Each heater core 300 includes a plurality of power pins 301, 302, 303, 304, and 305 as shown. Similar to the forms described above, the power pins are made of different conductive materials, and more specifically, power pins 301, 304, and 305 are made of a first conductive material, power pins 302, 303, and 306 are made of a second conductive material that is dissimilar from the first conductive material. As further shown, at least one jumper 320 is connected between dissimilar power pins, and in this example, power pin 301 and power pin 303, in order to obtain a temperature reading proximate the location of the jumper 320. The jumper 320 may be, for example, a lead wire or other conductive member sufficient to obtain the millivolt signal indicative of temperature proximate the location of the jumper 320, which is also in communication with the controller 70 as illustrated and described above. Any number of jumpers 320 may be used across dissimilar power pins, and another location is illustrated at jumper 322 between power pin 303 and power pin 305, between ZONE 3 and ZONE 4.

In this exemplary form, power pins 301, 303, and 305 are neutral legs of heater circuits between adjacent power pins 302, 304, and 306, respectively. More specifically, a heater circuit in ZONE 1 would be between power pins 301 and 302, with the resistive heating element (e.g., element 22 shown in FIG. 1) between these power pins. A heater circuit in ZONE 2 would be between power pins 303 and 304, with the resistive heating element between these two power pins. Similarly, a heater circuit in ZONE 3 would be between power pins 305 and 306, with the resistive heating element between these two power pins. It should be understood that these heater circuits are merely exemplary and are constructed according to the teachings of a cartridge heater described above and with reference to FIG. 1.

Figure 15:
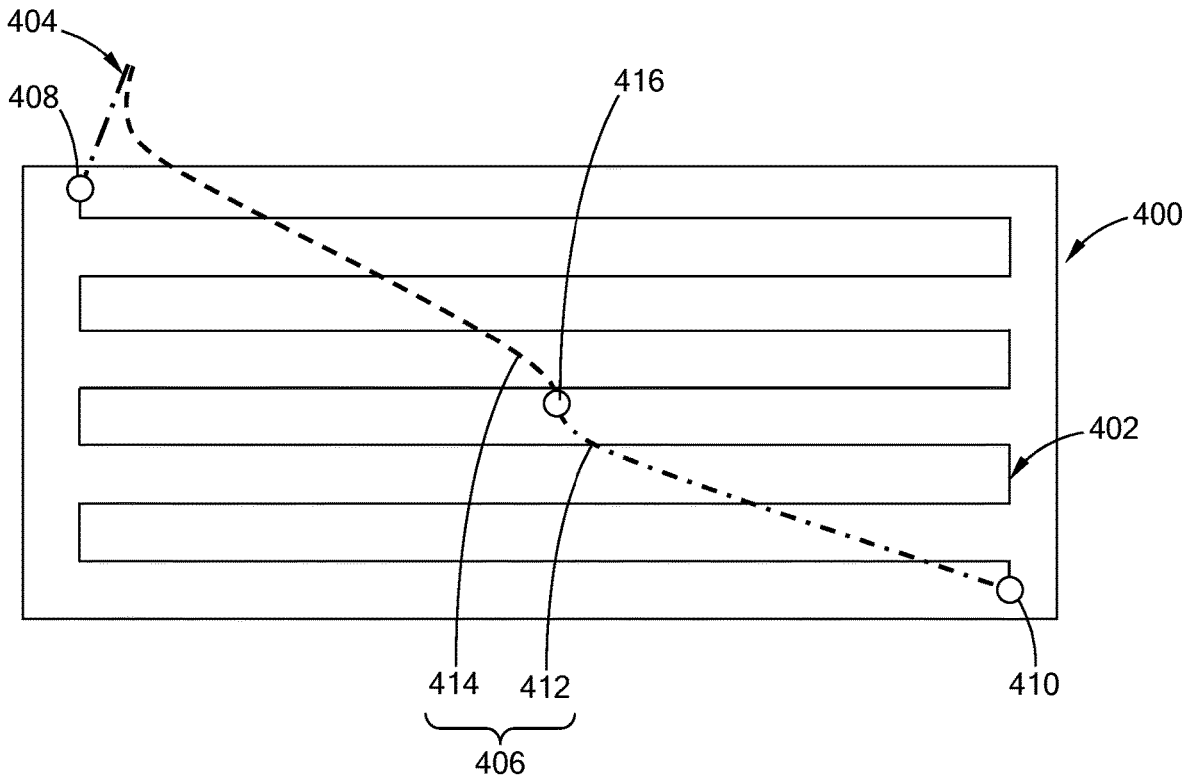
FIG. 15 illustrates a heater having a primary sensing junction in accordance with the teaching of the present disclosure.

Referring now to FIG. 15, in one form, a heater 400 is configured to include a primary sensing junction that can be arranged within the heater 400 or outside the heater 400 for measuring temperature. The heater 400 includes a resistive heating element 402, a first power pin 404, and a second power pin 406. The resistive heating element 402 has a first end and a second end. The first power pin 404 is connected to the first end of the resistive heating element 402 to form a first junction 408, and the second power pin 406 is connected to the second end of the resistive heating element 402 to form a second junction 410. The first power pin 404 and the second power pin 406 are operable to supply power to the heating element 402 by way of the controller.

The second power pin 406 includes a first lead wire 412 and a second lead wire 414. The first lead wire 412 is connected to the second end of the resistive heating element 402 to form the second junction 410, and the second lead wire 414 is connected to the first lead wire 412 to form a primary sensing junction 416 at a first reference area. The second lead wire 414 is configured to connect the resistive heating element 402 to the controller by way of the first lead wire 412.

In one form, the first lead wire 412 and the second lead wire 414 are made of dissimilar conductive materials or more particularly, materials having different Seebeck coefficients. For example, various combinations of nickel alloys, iron, constantan, Alumel® or the like may be used. The difference in material of the first lead wire 412 and the second lead wires 414 is represented by the different style lines in FIG. 15 (e.g., dash line for the second lead wire 414 and dashed-dotted line for first lead wire 412). Since the materials are different, the primary sensing junction 416 is effectively a thermocouple to generate a voltage change that is measured to determine a temperature at the first reference area. Accordingly, in this form, the junctions 408 and 410 for connecting to the resistive heating element 402 is separated from a sensing location. Thus, the heater 400 is not restricted to detecting temperature at the ends of the heating element 402, and a temperature measurement may be detected at various locations within the heater 400. Furthermore, in one form, the first lead wire 412 and the second lead wire 414 are configured to have the primary sensing junction 416 outside of the heater 400.

As discussed with respect to FIG. 2, the controller (not shown in FIG. 15) is in communication with the first power pin 404 and the second power pin 406 and is configured to supply power to the resistive heater element 402 via the power pins 404 and 406. The controller is also configured to calculate the temperature at the first reference area based on the voltage change created by the sensing junction 416 using the Seebeck coefficients of the materials.

In one form, the resistive heating element 402, the first power pin 404, and the first lead wire 412 of the second power pin 406 are made of the same conductive material or of materials with similar Seebeck properties (i.e., substantially the same Seebeck coefficients). Accordingly, a voltage change created by the first junction 408 and the second junction 410 is substantially zero, and the temperature measurement determined by the controller is based on the voltage change created by the primary sensing junction 416.

In another form, the resistive heating element 402, the first power pin 404, and/or the first lead wire 412 of the second power pin 406 are made of different conductive materials. With such configurations, the material of the second lead wire 414 is selected such that the Seebeck coefficient of the second lead wire 414 is the most dissimilar from that of the resistive heating element 402, the first power pin 404, and the first lead wire 412 of the second power pin 406. Accordingly, the primary sensing junction 416 is provided as the largest contributor to overall temperature measurement, and any temperature measurement from the first and second junctions 408 and 410 are minimized.

As discussed above, the temperature can be detected at the zero-crossing of the power signal. Alternatively, the controller is configured to switch between a heating mode for directing power to the resistive heating element and a measuring mode for measuring changes in voltage at the primary sensing junction 416 to determine the temperature at the reference area.

Figure 16:
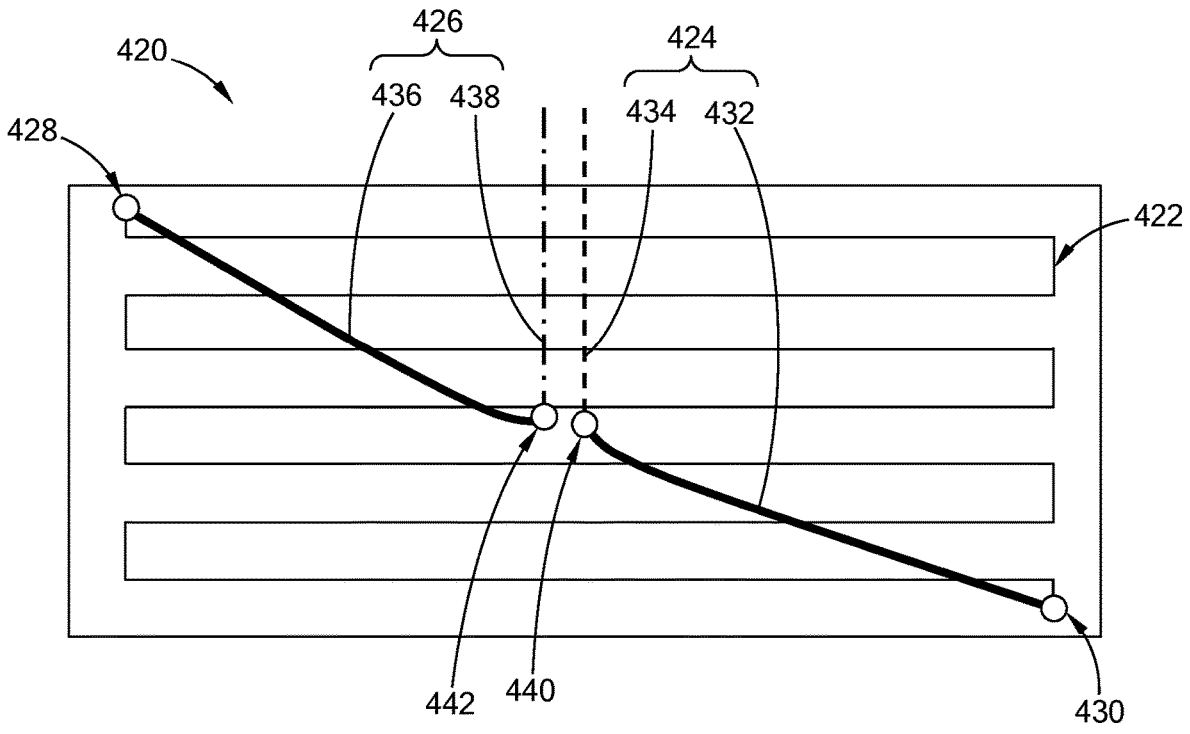
FIG. 16 illustrates a heater having two primary sensing junctions in accordance with the teachings of the present disclosure.

Referring to FIG. 16, in one form, a heater 420 includes two sensing junctions in proximity to each other to detect a temperature at a virtual point between the two sensing junctions. Here, the heater 420 comprises a resistive heating element 422, a second power pin 424, and a first power pin 426. The resistive heating element 422 comprises a first end and a second end. The first power pin 426 forms a first junction 428 with the first end of the heating element 422, and the second power pin 424 forms a second junction 430 with the second end of the heating element 422. The second power pin 424 is configured in a similar manner as the second power pin 406 of FIG. 15, and thus, includes a first lead wire 432 that is connected to the resistive heating element 422 to form the second junction 430, and a second lead wire 434 that is connected to the first lead wire 432 to form a first primary sensing junction 440 at a first reference area within the heater 420.

In this form, the first power pin 426 is configured in a similar manner as the second power pin 424, and comprises two lead wires (i.e., a third lead wire 436 and a fourth lead wire 438) to form a sensing junction. More particularly, the third lead wire 436 is connected to the first end of the resistive heating element 422 to form the first junction 428, and the fourth lead wire 438 forms a second primary sensing junction 442 with the third lead wire 436 at a second reference area. The second primary sensing junction 442 is provided at a second reference area of the heater 420 that is adjacent and proximate to the first reference area having the first primary sensing junction 440. While the sensing junctions 440 and 442 are provided as within the heater 420, the sensing junctions 440 and 442 can also be provided outside the heater 420.

Similar to the second power pin 424, the third lead wire 436 is made of a different conductive material than that of the fourth lead wire 438, and is of different conductive material as that of the second lead wire 434 of the second power pin 424. Accordingly, the second primary sensing junction 442 is effectively a thermocouple used in conjunction with the first primary sensing junction to determine a temperature between the first and second reference areas. Furthermore, the resistive heating element 422, the first lead wire 432 of the second power pin 424, and the third lead wire 436 of the first power pin 426 are made of the same conductive material or of materials with similar Seebeck properties, such that a voltage change created by the first junction 428 and the second junction 430 is substantially zero, and the temperature measurement determined by the controller is based on the voltage changes at the sensing junctions 440 and 442.

The controller (not shown in FIG. 16) is configured to supply power to the heating element 422 via the first power pin 426 and the second power pin 424, and to measure a temperature at a virtual point between the two sensing junctions 440 and 442 based on the voltage changes created by the junctions 440 and 442. In one form, the temperature at the first and second reference areas are presumed to be substantially the same, and thus, the temperature detected by the controller is associated with a virtual point between the first and second reference areas.

Figure 17B:
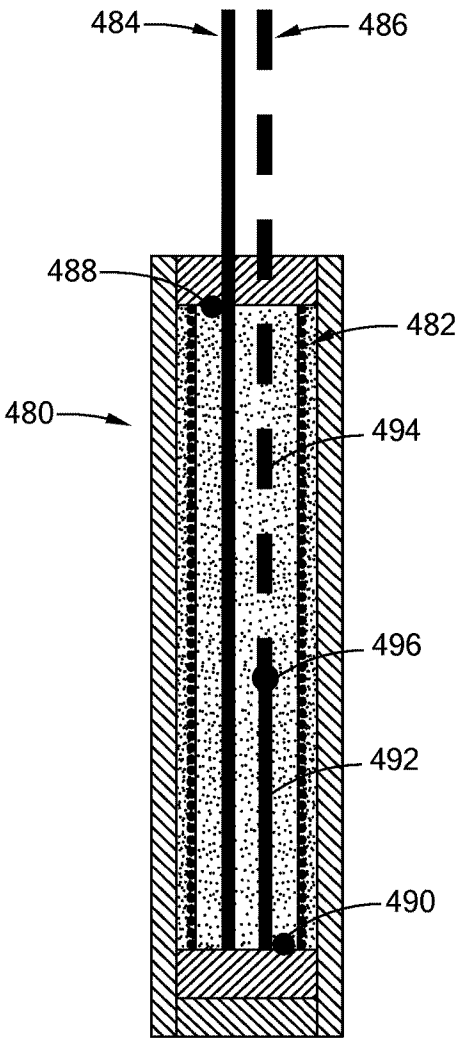
FIGS. 17A and 17B are perspective views of cartridge heaters having primary sensing junctions in accordance with teachings of the present disclosure.
Figure 17A:
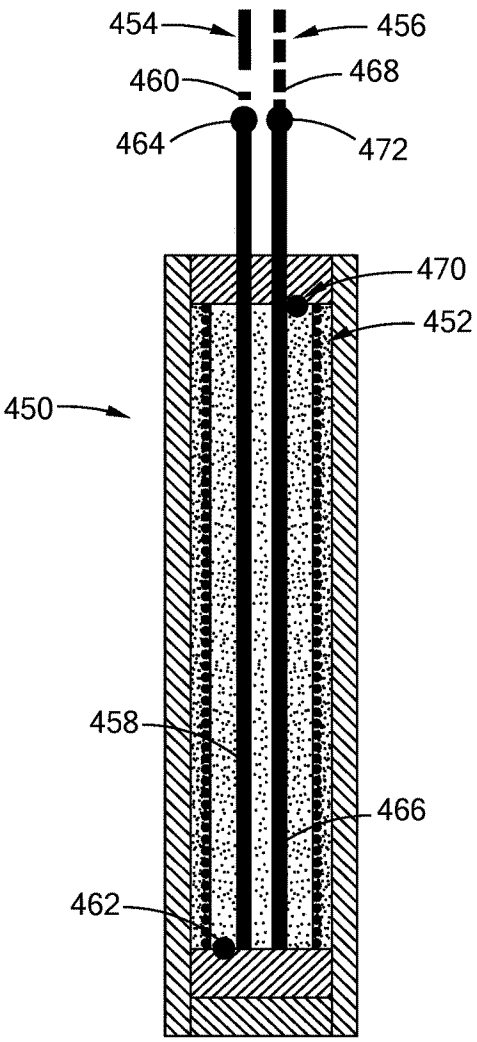

Referring to FIG. 17A and FIG. 17B, in one form, the primary sensing junction is provided in a cartridge heater for measuring a temperature at a virtual point outside of the heater or at a reference area within the heater. FIG. 17A illustrates a cartridge heater 450 that includes a resistive heating element 452 in the form of a metal wire, a first power pin 454, and a second power pin 456. The cartridge heater 450 is configured to include two sensing junctions provided outside of the heater 450 to measure a temperature at a virtual point between the two sensing junctions.

More particularly, in one form, the resistive heating element 452 is wound or disposed around a non-conductive portion (or a core in this form) as discussed with respect to FIG. 1. The first power pin 454 comprises a first lead wire 458 and a second lead wire 460. The first lead wire 458 is connected to the first end of the resistive heating element 452 to form a first junction 462, and the second lead wire 460 forms a first primary sensing junction 464 with the first lead wire 458 at a first reference area outside the heater 450. The second power pin 456 comprises a third lead wire 466 and a fourth lead wire 468. The third lead wire 466 is connected to the resistive heating element 452 to form a second junction 470. The fourth lead wire 468 is connected to the third lead wire 466 to form a second primary sensing junction 472 at a second reference area outside the heater 450. The first and second primary sensing junctions 464 and 472 are positioned adjacent and in proximity to one another.

In one form, the resistive heating element 452, the first lead wire 458 of the first power pin 454, and the third lead wire 466 of the second power pin 456 are made of the same material or of materials having similar Seebeck properties, and are different from the material of the second lead wire 460 of the first power pin 454 and the fourth lead wire 468 of the second power pin 456. In addition, the material of the second lead wire 460 of the first power pin 454 is different from the material of the fourth lead wire 468 of the second power pin 456. Accordingly, the first and second primary junctions 464 and 472 operate as thermocouples to detect a temperature at a virtual point between the two junctions 464 and 472.

FIG. 17B illustrates a cartridge heater 480 having one primary sensing junction located within the heater. The cartridge heater 480 includes a resistive heating element 482 having two ends, a first power pin 484, and a second power pin 486. The first power pin 484 forms a first junction 488 with a first end of the heating element 482 and the second power pin 486 forms a second junction 490 with a second end of the heating element 482. Similar to the heater of FIG. 15, the second power pin 486 includes a first lead wire 492 and a second lead wire 494, which are made of different material (i.e., have different Seebeck coefficients). The first lead wire 492 is connected to the second end of the resistive heating element 482 to form the second junction 490, and the second lead wire 494 is connected to the first lead wire 492 to form a primary sensing junction 496 at a first reference area within the heater 480. Accordingly, the primary sensing junction 490 is operable as a thermocouple to measure a temperature at the first reference area.

In one form, the resistive heating element 482, the first power pin 484, and the first lead wire 492 of the second power pin 486 are made of the same conductive material or of materials having similar Seebeck properties. Accordingly, a voltage change created by the first junction 488 and the second junction 490 is substantially zero, and the temperature measurement determined by the controller is based on the voltage change created by the primary sensing junction 490.

Figure 18:
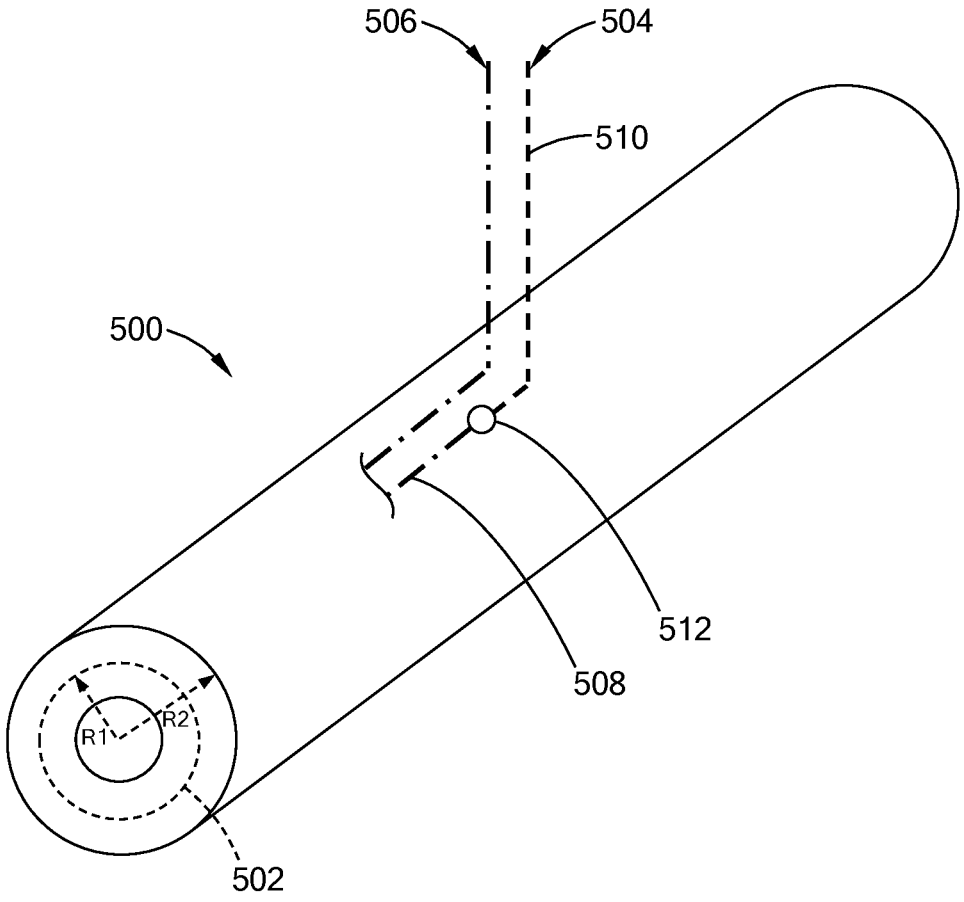
FIG. 18 is a perspective via tubular heater having a primary sensing junction and a two-wire heating element in accordance with teachings of the present disclosure.

Referring to FIG. 18, the primary sensing junction of the present disclosure may also be used as part of a heat flux sensor to estimate a temperature between inner surface of a heater and an outer surface of the heater. More particularly, in one form, a heater 500 is operable to heat a fluid (e.g., a gas) following through a tube, and comprises a resistive heating (i.e., thermal) element 502 (shown with phantom lines), a first power pin 504, and a second power pin 506. While not fully illustrated in FIG. 18, the resistive heating element 502 is configured to extend through the heater 500, and is protected by a cover. The first power pin 504 and the second power pin 506 extend into the cover of the heater 500 to form a first junction with a first end of the heating element 502 and a second junction with a second end of the heating element 502, respectively.

The resistive heating element 502 is a "two-wire" heating element such that it functions as a heater and as a temperature sensor. Such two-wire capability is disclosed in, for example, U.S. Pat. No. 7,196,295, which is commonly assigned with the present application and incorporated herein by reference in its entirety. Generally, for a two-wire system, the heating element 502 is made of a high temperature coefficient of resistance (TCR) material. A controller (not shown in FIG. 18) is in communication with the first and second power pins 504 and 506, and configured to measure voltage (i.e., mV) changes across the power pins 504 and 506. Using the voltage change, the controller calculates an average temperature of the resistive heating element 502 (e.g., about R1).

The first power pin 504 includes a first lead wire 508 and a second lead wire 510, which are made of different materials (i.e., have different Seebeck coefficients). The first lead wire 508 forms the second junction with the heating element 502, and the second lead wire 510 forms a primary sensing junction 512 with the first lead wire 508 at a second reference area that is along an outer surface (i.e., R2) of the heater 500 (i.e., along a plane that is different than that of the heating element 502). Accordingly, the primary sensing junction 512 is operable as a thermocouple to measure a temperature at the second reference area based on a voltage change created by the sensing junction 512. The resistive heating element 502, the second power pin 506, and the first lead wire 508 of the first power pin 504 are made of the same material or made of materials having similar Seebeck properties.

In one form, the controller is configured to estimate a temperature at a virtual point between an inner surface (i.e., first reference area) and an outer surface (a second reference area) of the heater 500 based on the temperature measurement of the heating element 502, the temperature at the primary sensing junction 512, and power delivered to the heater 500 from the controller. More particularly, the controller determines the average temperature of the heating element at the first reference area using the voltage change across the power pins 506 and 504, as described with respect to the two-wire system. The controller further determines the temperature at the second reference area based on the voltage change created by the primary sensing junction 512 and the Seebeck coefficient of the first and second lead wire 508 and 510. Using the two measurements, the power being provided, and the heater geometry, the controller may calculate a temperature at a third reference area at a desired location in the heater 500 (e.g., any location within the heater). In addition, if the geometry of the heater 500 is known, the controller can also be configured to determine a heat flux between the inner surface and the outer surface of the heater 500. The heat flux can be used to, for example, detect entry areas of cold fluid, adjust temperature setpoints, and/or other suitable system controls. While the heater 500 is illustrated as a tube, the heater may be configured in other suitable shapes (e.g., a flat plate) and still be within the scope of the present disclosure.

Furthermore, in one form, before the heater 500 is energized, the heater 500 is substantially at room temperature, such that the primary sensing junction 512 is at the same or substantially the same temperature as the high TCR element wire (i.e., the heating element 502). The controller is configured to measure the temperature using the primary sensing junction 512, and further measure the resistance of the heating element 502. The controller associates the resistance of the heater 500 with the temperature measured by the primary sensing junction 512, and uses this baseline value to covert other resistances to a temperature, thereby calibrating the heater element 502.

Figure 19:
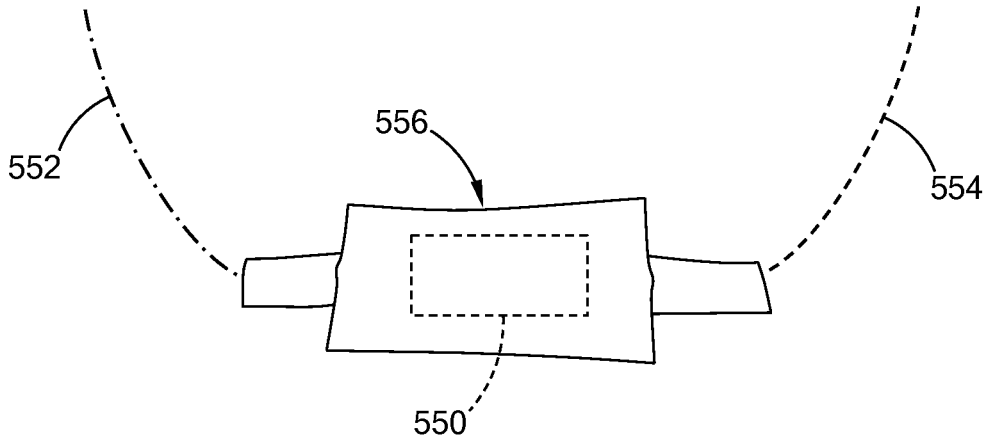
FIG. 19 illustrates a primary sensing junction with enhanced temperature measurement features in accordance with teachings of the present disclosure.

Referring to FIG. 19, a primary sensing junction can be configured in various suitable ways to improve temperature measurement along a surface. For example, in one form, a primary sensing junction 550 is formed by a first lead wire 552 and a second lead wire 554 that are made of different materials. The sensing junction 550 has a planar shape (i.e., flat) and is surrounded by a heat diffuser 556 that is a thermally conductive material (e.g., copper) to improve thermal contact with the surface and to diffuse heat coming from the heating element.

The primary sensing junction of the present disclosure operates as a thermocouple to enables temperature measurements at different locations within and even, outside of the heater. Accordingly, temperature measurement is not restricted to the ends of the heating element. In addition, the heater no longer requires a discrete temperature sensor, thereby reducing the complexity of the heater.

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A heater comprising:

a resistive heating element;

a first power pin forming a first junction with a first end of the resistive heating element; and a second power pin comprising:

a first lead wire forming a second junction with a second end of the resistive heating element and defining a first conductive material; and a second lead wire forming a primary sensing junction with the first lead wire at a first reference area, wherein the second lead wire defines a second conductive material different from the first conductive material to measure a temperature at the first reference area based on a voltage change created by the primary sensing junction, wherein the first power pin and the first lead wire of the second power pin are made of the same material.

2. The heater of claim 1, wherein the first power pin, the first lead wire of the second power pin, and the resistive heating element are made of the same material.

3. The heater of claim 1 further comprising a controller in communication with the first power pin and the second power pin, wherein the controller is configured to switch between a heating mode for directing power to the resistive heating element and a measuring mode for measuring the voltage change created by the primary sensing junction to determine the temperature at the first reference area.

4. The heater of claim 1 further comprising a controller in communication with the first and second power pins and configured to measure changes in voltage at the first and second junctions without interrupting power to the resistive heating element.

5. The heater of claim 1, wherein a Seebeck coefficient of the first power pin, the first lead wire of the second power pin, and the resistive heating element are substantially the same.

6. The heater of claim 1, wherein the primary sensing junction is arranged along the resistive heating element between the first end and the second end of the resistive heating element.

7. The heater of claim 1, wherein the primary sensing junction is arranged outside the heater.

8. The heater of claim 1, wherein the first power pin comprises:

a third lead wire connected to the first end of the resistive heating element to form the first junction, and the third lead wire defines the first conductive material, and a fourth lead wire that forms a second primary sensing junction with the third lead wire at a second reference area that is adjacent and in proximity to the first reference area, wherein the fourth lead wire defines a third conductive material different from the first conductive material and the second conductive material to operate as a thermocouple and used in conjunction with the primary sensing junction to determine a temperature between the first and second reference areas.

9. The heater of claim 8, wherein Seebeck coefficients of the first lead wire of the second power pin, the third lead wire of the first power pin, and the resistive heating element are substantially the same.

10. The heater of claim 1 further comprising a heat diffuser arranged about the primary sensing junction.

11. The heater of claim 1 further comprising:

a non-conductive portion defining a proximal end and a distal end, the non-conductive portion having first and second apertures extending through at least the proximal end, wherein the first and second power pins are disposed within the first and second apertures, and the resistive heating element is disposed around the non-conductive portion;

a sheath surrounding the non-conductive portion; and a sealing member disposed at the proximal end portion of the non-conductive portion and extending at least partially into the sheath.

12. A heater comprising:

a resistive heater element operable in a heat mode and a sensing mode, wherein in the sensing mode the resistive heater element senses a temperature at a first reference area along the resistive heater;

a first power pin forming a first junction with a first end of the resistive heater; and a second power pin comprising:

a first lead wire forming a second junction with a second end of the resistive heater and defining a first conductive material, and a second lead wire forming a primary sensing junction with the first lead wire at a second reference area, wherein the second lead wire defines a second conductive material different from the first conductive material to measure a temperature at the second reference area based on a voltage change created by the primary sensing junction, wherein the first power pin, the first lead wire of the second power pin, and the resistive heater define one or more conductive materials having substantially the same Seebeck coefficient.

13. The heater of claim 12 further comprising a controller in communication with the first power pin and the second power pin, wherein:

the controller is configured to switch between the heating mode for directing power to the resistive heater, and the sensing mode for measuring resistance of the resistive heater to determine the temperature at the first reference and for measuring changes in voltage created by the primary sensing junction to determine the temperature at the second reference area, and the controller is configured to calculate a temperature at a third reference area based on the temperatures at the first reference area, the second reference area, heater geometry, and power delivered to the heater element.

14. The heater of claim 13, wherein the controller is configured to calibrate the heater using a temperature measured by the primary sensing junction.

15. The heater of claim 12, wherein the primary sensing junction is formed along a plane that is different than that of heater.

16. The heater of claim 12 further comprising a heat diffuser arranged about the primary sensing junction.

17. A heater comprising:

a resistive heating element;

a first power pin forming a first junction with a first end of the resistive heating element; and a second power pin comprising:

a first lead wire forming a second junction with a second end of the resistive heating element;

a second lead wire forming a primary sensing junction with the first lead wire at a reference area, wherein:

the resistive heating element, the first power pin, and the first lead wire are made of a first material, and the second lead wire is made of a second material having a different Seebeck coefficient than that of the first material to measure a temperature at the reference area based on a voltage change created by the primary sensing junction.

18. The heater of claim 17, wherein the primary sensing junction is arranged along the resistive heating element between the first end and the second end of the resistive heating element.

* * * * *